US008317024B1

(12) United States Patent
Persi

(10) Patent No.: US 8,317,024 B1
(45) Date of Patent: Nov. 27, 2012

(54) FOOD STORAGE APPARATUS

(76) Inventor: John S. Persi, Phoenix, AZ (US)

( * ) Notice: Subject to any disclaimer, the term of this patent is extended or adjusted under 35 U.S.C. 154(b) by 0 days.

(21) Appl. No.: 13/289,622

(22) Filed: Nov. 4, 2011

(51) Int. Cl.
*B65D 1/24* (2006.01)

(52) U.S. Cl. ..... 206/508; 206/509; 220/521

(58) Field of Classification Search ..... 206/508, 206/509, 511; 220/521, 23.86, 212
See application file for complete search history.

(56) References Cited

U.S. PATENT DOCUMENTS 5,722,558 A * 3/1998 Thompson ..... 220/521
5,826,718 A * 10/1998 Ahern et al. ..... 206/372

* cited by examiner

*Primary Examiner* — Stephen Castellano
(74) *Attorney, Agent, or Firm* — Thomas W. Galvani, P.C.; Thomas W. Galvani

(57) ABSTRACT

A stacked food storage apparatus includes a first container having a lid with an outer surface. Discontinuous first and second protuberances are carried by the lid and extend upwardly with respect to the lid. A second container includes a base having opposed inner and outer surfaces. Discontinuous first and second sockets are formed in the base and extend upwardly with respect to the base. The second container moves between a free position and a stacked position with respect to the first container. In the stacked position of the second container, the first and second protuberances releasably nest with the first and second sockets, respectively. Interference fits between the first protuberance and the first socket, and between the second protuberance and the second socket, attach the first container to the second container and restrict relative movement of the first container with respect to the second container.

8 Claims, 12 Drawing Sheets

FOOD STORAGE APPARATUS

FIELD OF THE INVENTION

The present invention relates generally to containers, and more particularly to food storage containers.

BACKGROUND OF THE INVENTION

Food establishment customers frequently carry food home after a meal at a restaurant, order food to be picked up at and carried away from the restaurant, or take away food from a deli, grocery store, food truck, or other food establishment. Food establishments use a variety of containers and packaging methods to send food home with customers, placing food within cardboard, polystyrene, or plastic containers and then stacking, bundling, or placing those containers within paper or plastic bags for customers.

The methods and apparatuses used by a food establishment to pack carry-home food vary with the nature of a customer's order and the practice of the food establishment. A customer may order a single entrée, multiple entrees, salads, desserts, meals that require cheese toppings, pepper flakes, pickles, olives, or sweet peppers, or meals that require dipping sauces or dressings, such as nacho cheese, syrup, caramel, chocolate, or ranch dressing. Food establishments place foods such as these in different containers which can be large or small. Some of these containers and packages stack or fit within each other, while others do not. When customers order meals that are accompanied by smaller food items such as pickles, cheeses, side dishes, and the like, food establishment workers often simply hand the smaller food items to the customer. This creates many separate objects for the customer to carry and manage on the way home. Alternatively, the food establishment workers bundle the larger food containers within a plastic bag and then place the smaller food items within the bag as well. This creates one single large bag that the customer must manage and keep upright on the way home. In another manner, the food establishment workers simply place all the food items within the larger food containers.

Larger containers for transporting entrees and large dishes are available in a variety of shapes and sizes. For instance, larger containers have rectangular, square, circular, octagonal, and a variety of other footprints, and range in size from small to large. Rectangular food container, for example, are available in approximate sizes of 7.125 inches wide by 3.75 inches long by 2.25 inches high, 9 inches wide by 9 inches long by 3 inches high, and 13 inches wide by 9.75 inches high by 3.75 inches high. Larger containers are frequently formed with sidewalls within the lower portion of the container to create compartments for separately storing multiple types of food within the same container.

While some smaller food items, such as pickles, olives, cheese packets, and the like, often do not need to be placed within their own individual container, others do, such as dipping sauces and dressings. Food establishment workers frequently use soufflé cups for such food items. Soufflé cups are typically small cylindrical containers, approximately 1.5 inches deep, 3 inches in diameter, holding between 1.5 and 4 ounces in volume, and are generally fitted with a snap-on lid.

Soufflé cups are bundled with food orders in a number of ways. For instance, many delis, grocery stores, and specialty chain grocers either pre-package food on-site or have a commissary which places food in food containers. Such food establishments often place soufflé cups containing sauces, sides, and the like, inside a larger food container already storing a larger food item and then set out the bundled food containers in a refrigerated display case ready for the customer to purchase and take home. Alternatively, other food establishments often fill soufflé cups filled and cap the cups with lids prior to sale, placing the cups next to a food establishment cash register in preparation for bundling with the larger food items when the customer arrives to take the meal away. Soufflé cups are sometimes prepared by a kitchen worker, but may be filled and capped by the register worker, someone whose hands may not be clean because they frequently greet people and handle a large amount of money. Even when they are not directly prepared by the cashier working the register, soufflé cups are frequently bundled with the food by the cashier. The cashier has a number of options in bundling the soufflé cups: she can open the food containers and place them inside the food storage area of the food containers so that the soufflé cups touch the ordered food, she can place the food containers in a plastic bag and then place the soufflé cups in the bag as well, she can hand the soufflé cups directly to the customer separately from the food, or she can do something else. Cashiers and kitchen staff frequently place the soufflé cups directly inside the food containers together with the food.

When a soufflé cup is placed inside a food container, germs from the hands of the cashier or others who have handled the cup are placed in direct contact with the food in the food container, risking contamination, food poisoning, and other food safety hazards and effects. Additionally, the sides of the soufflé cup may be covered in excess food due to a sloppy pour or a leaky lid, which can cause the food on the sides to be unintentionally spread on the food within the food container. During transportation, the lid on the soufflé cup can detach from the cup and spill within the food container, causing unwanted and uncontrolled application of the soufflé cup contents to the food in the food container.

When a soufflé cup is placed in a bag along with a food container, if the sides of the soufflé cup are covered in excess food due to a sloppy pour or leaky lid, the interior of the bag and the exterior of the food container can become quite messy, requiring the customer to be very careful when he removes the food container from the bag, and probably requiring clean up after doing so. The lid on the soufflé cup can detach from the cup while it is in the bag and can spill within the bag. If the bag is fluid impervious, this creates a mess within the bag that must be cleaned up later. If the bag is made of paper or has a hole, the spilled contents of the soufflé cup can cause a mess outside the bag, namely, in customer's car, on the customer's clothes, or on the customer's floor.

When a soufflé cup is handed directly to the customer, if the sides of the soufflé cup are covered in excess food due to a sloppy pour or leaky lid, the customer's hands and clothes can become messy. If the lid on the soufflé cup detaches during transportation, the food within the cup can spill on the customer, the customer's car, or the customer's floors.

When a customer has ordered multiple entrees, the food establishment likely gives him multiple food containers to manage. Multiple food containers are difficult to manage. If they are stacked on top of each other, they can slide off or tip over. When a customer drives home with multiple food containers, while negotiating the road he may have to take a hand off the wheel in order to hold the food containers and ensure they do not spill. If multiple food containers are placed in a bag, they can become jostled within the bag, possibly forcing the lid of a container open, spilling its contents, or wedging one container within another.

SUMMARY OF THE INVENTION

According to the principle of the invention, a stacked food storage apparatus includes a first container having a lid with an outer surface. Discontinuous first and second protuberances are carried by the lid, and each of the protuberances extends upwardly with respect to the outer surface of the lid. A second container includes a base having opposed inner and outer surfaces. Discontinuous first and second sockets are formed in the base, and each of the sockets extends upwardly with respect to the inner surface of the base. The second container is moveable between a free position released from the first container and a stacked position applied to the first container. In the stacked position of the second container, the first and second protuberances releasably nest with the first and second sockets, respectively, wherein there is a first interference fit between the first protuberance and the first socket, a second interference fit between the second protuberance and the second socket, and the first and second interference fits attach the first container to the second container and restrict relative movement of the first container with respect to the second container. The outer surface of the base of the second container is in contact with the outer surface of the lid of the first container. The first interference fit is characterized in that the first protuberance relates to and frictionally engages the first socket, and the second interference fit is characterized in that the second protuberance relates to and frictionally engages the second socket. In an embodiment according to the principle of the invention, a cup is formed in the lid of the first container and the first protuberance comprises an extension of the cup. The second protuberance comprises a protrusion formed in the lid of the first container extending upwardly from the outer surface of the lid of the first container, a cup-receiving seat is formed in the lid of the first container, and the cup is fitted in the seat. The cup includes a top, an opposed bottom, a food containment area formed between the top and the bottom, and a height extending between the top and bottom. The cup is moveable between free and storage positions relative to the seat. In the free position of the cup, the cup is removed from the seat. In the storage position of the cup, the cup is received into the seat, a majority of the height of the cup extends into the seat, and a majority of the food containment area of the cup extends into the seat. There exists a third interference fit between the seat and the cup in the storage position of the cup, wherein the third interference fit is characterized in that the cup relates to and frictionally engages the seat. A first dimension of the height of the cup extends from the bottom of the cup to a middle portion of the cup located between the top and the bottom of the cup. A second dimension of the height of the cup extends from the middle portion of the cup to the top of the cup. The first dimension is greater than the second dimension. In the storage position of the cup, the first dimension extends into the seat from the middle portion of the cup at the outer surface of the lid to the bottom of the cup, and the second dimension extends away from the outer surface of the lid from the middle portion of the cup at the outer surface of the lid to the top of the cup. The middle portion of the cup is co-planar with respect to the outer surface of the lid, and the extension of the cup comprises the second dimension of the cup. A cap is applied to the cup, and the cap comprises the second dimension of the cup.

According to the principle of the invention, a stacked food storage apparatus includes a first container having a lid, a seat formed in the lid, and a second having including a base, a socket formed in the base. The second container is moveable between a free position away from the first container and a stacked position applied to the lid of the second container. A cup is moveable between a free position removed from the lid and a storage position applied to the seat formed in the lid. In the storage position of the cup, the cup forms an engagement assembly between the first and second containers, and the engagement assembly includes the cup in the storage position thereof and the socket formed in the base. In the storage position of the cup and in the stacked position of the second container, the base of the second container directly contacts the lid of the first container, and the engagement assembly releasably secures the second container to restrict relative movement of the first and second containers. The cup has a top, an opposed bottom, and an outer sidewall extending between the top and the bottom. The socket has a top and an inner sidewall, and the seat has a bottom and an inner sidewall. In the storage position of the cup and in the stacked position of the second container, the top of the cup extends into the socket so as to be positioned near the top of the socket, the inner sidewall of the socket closely encircles the outer sidewall of the cup, the bottom of the cup depends downwardly into the seat so as to be positioned near the bottom of the seat, and the inner sidewall of the seat closely encircles the outer sidewall of the cup. The cup has a height extending from the bottom of the cup to the top of the cup. In the storage position of the cup and in the stacked position of the second container, a majority of the height of the cup depends downwardly into the seat relative to the lid of the first container, and a minority of the height of the cup extends upwardly into the socket relative to the base of the second container.

According to the principle of the invention, a food storage apparatus includes a base having opposed inner and outer surfaces, discontinuous first and second sockets formed in the base, and a lid moveable between an open position away from the base and a closed position toward the base. A protrusion is formed in the lid, and a cup-receiving seat is formed in the lid. A cup is moveable between free and storage positions relative to the seat. The cup includes a top, an opposed bottom, a food containment area formed between the top and the bottom, and a height extending between the top and bottom. In the closed position of the lid, the inner surface of the lid and the inner surface of the base cooperate to bound a food storage area formed between the base and the lid. In the closed position of the lid, the protrusion in the lid relates to and is spaced apart from the first socket in the base, and the seat in the lid relates to and is spaced apart from the second socket in the base. In the storage position of the cup, the cup is received in the seat, a majority of the height of the cup extends into the seat, and a majority of the food containment area extends into the seat. In the storage position of the cup, an interference fit couples the seat and the cup in the storage position of the cup, wherein the interference fit restricts relative movement of the cup and the seat, and is characterized in that the cup relates to and frictionally engages the seat. A first dimension of the height of the cup extends from the bottom of the cup to a middle portion of the cup, and a second dimension of the height of the cup extends from the middle portion of the cup to the top of the cup. In the storage position of the cup, the first dimension extends into the seat from the middle portion of the cup at the outer surface of the lid to the bottom of the cup, and the second dimension extends away from the outer surface of the lid from the middle portion of the cup at the outer surface of the lid to the top of the cup. The middle portion of the cup is co-planar with respect to the outer surface of the lid. A third dimension of the protrusion extends from the outer surface of the lid to a top of the protrusion. The second dimension of the cup is equal to the third dimension of the protrusion extending from the outer surface of the lid to the top of the protrusion. The protrusion has an outer diameter, and the first socket has an inner diameter. The outer diameter of the protrusion corresponds to the inner diameter of the first socket. The cup has an outer diameter, and the second socket has an inner diameter. The outer diameter of the cup corresponds to the inner diameter of the second socket. A fourth dimension of the first socket extends from the outer surface of the base to a top of the first socket, and the fourth dimension of the first socket is equal to the third dimension of the protrusion extending from the outer surface of the lid to the top of the protrusion. A fifth dimension of the second socket extends from the outer surface of the base to a top of the second socket, and the fifth dimension of the second socket is equal to the second dimension of the height of the cup extending from the middle portion of the cup to the top of the cup. The lid and the seat together comprise a unitary, fluid-impervious lid structure. In an embodiment according to the principle of the invention, the lid is mounted to the base for pivotal movement between the open and closed positions of the lid. In another embodiment according to the principle of the invention, in the open position of the lid, the lid is released from the base, and in the closed position of the lid, the lid is in contact with the base.

BRIEF DESCRIPTION OF THE DRAWINGS

Referring to the drawings.

DETAILED DESCRIPTION

Figure 1:
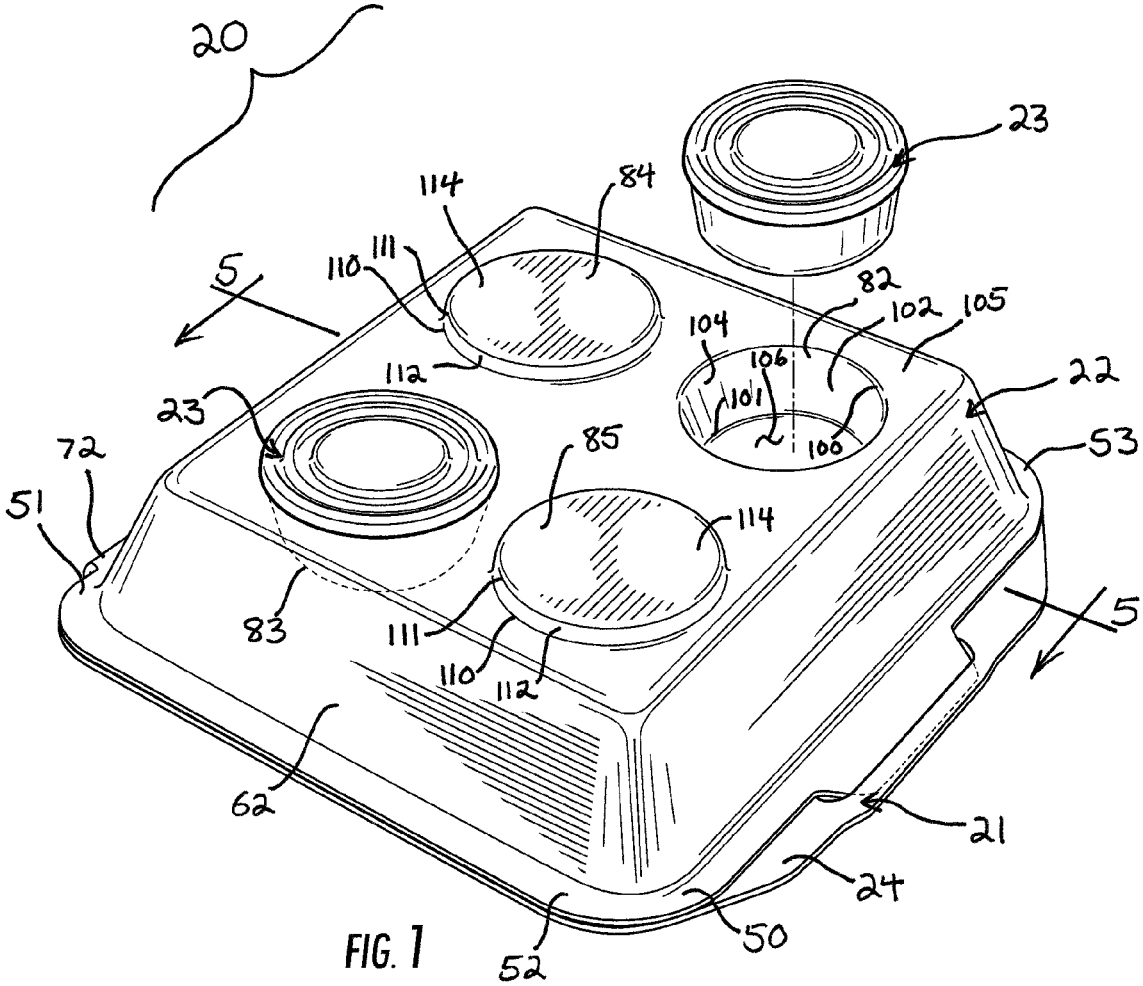
FIG. 1 is a top perspective view of a food storage apparatus constructed and arranged in accordance with the principle of the invention, including a base, a lid, a protrusion, a cup-receiving seat formed in the lid, and a cup.
Figure 2:
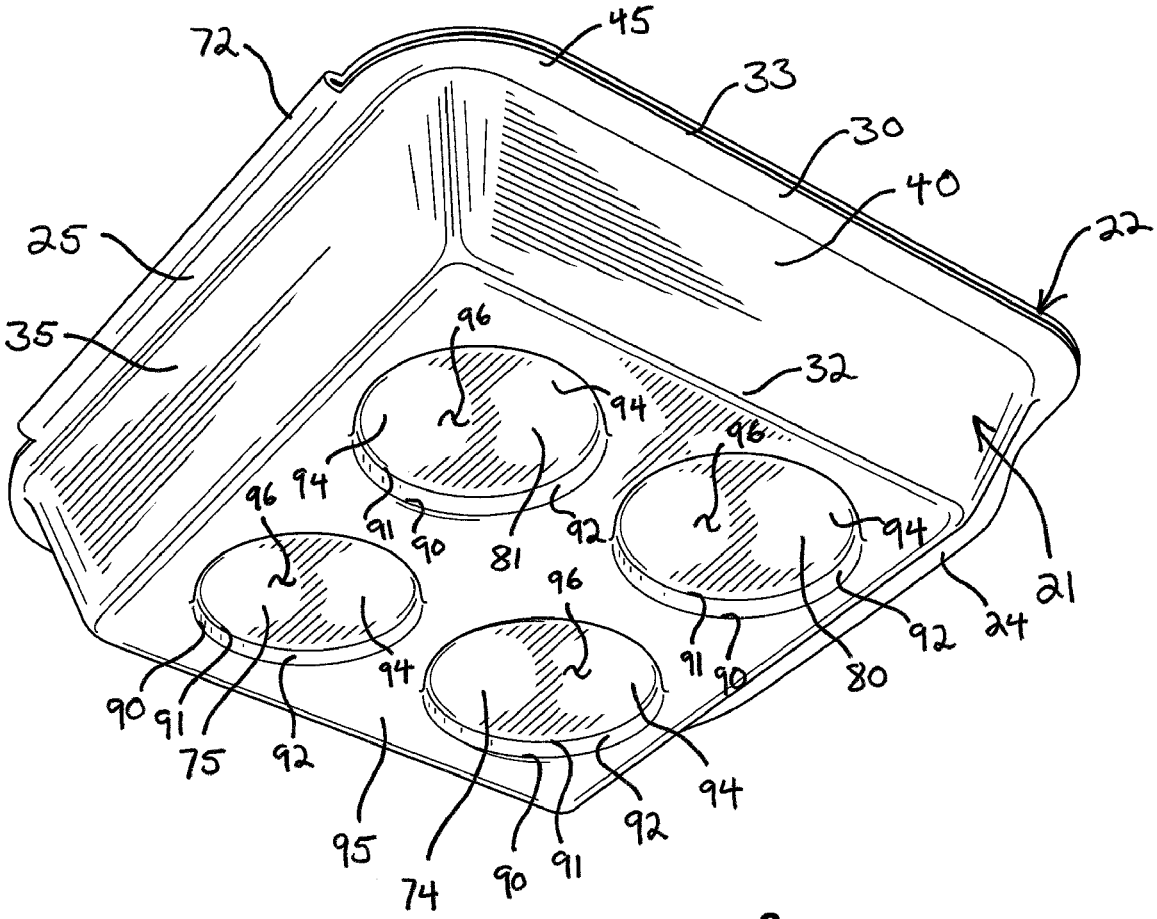
FIG. 2 is a bottom perspective view of the food storage apparatus of FIG. 1.

Turning now to the drawings, in which like reference characters indicate corresponding elements throughout the several views, attention is first directed to FIG. 1, illustrating a food storage apparatus 20. Food storage apparatus 20 includes a base 21, a lid 22, and a cup 23. Base 21 is shown in greater detail in FIGS. 2 and 3. Base 21 has a front 24, a rear 25, opposed sides 30 and 31, a bottom 32, and a top 33. Extending upwardly from bottom 32 to top 33 of base 21 is a front wall 34 at front 24 of base 21, a rear wall 35 at rear 25 of base 21, and opposed side walls 40 and 41 at opposed sides 30 and 31, respectively, which all together form a continuous sidewall 42 between bottom 32 and top 33 of base 21. Base 21 has an outer surface 43 and an opposed inner surface 44 which meet at and form a rim 45 extending along sidewall 42 at top 33 of base 21. Rim 45 defines an opening into a lower food storage 46 bound by inner surface 43 extending into base 21, as shown in FIG. 3.

Base 21 is fluid impervious and formed of plastic, polystyrene, molded foam, or like materials having light and rigid material characteristics. In the embodiment shown in FIG. 3, front, rear, and side walls 34, 35, 36, and 37 are generally rectangular and coextensive, but in other embodiments, other shapes and sizes are suitable, in which such embodiments front and rear walls 34 and 35 are one of shorter and longer than side walls 36 and 37. In other embodiments, front, rear, and side walls 34, 35, 36, and 37 cooperate to form a cylindrical sidewall about lower storage area 46. Although specific embodiments of the invention are herein described with reference to the drawings, it should be understood that such embodiments and the accompanying drawings are shown by way of example only, for illustrative purposes, and not to limit the invention to a specific shape or size.

Figure 3:
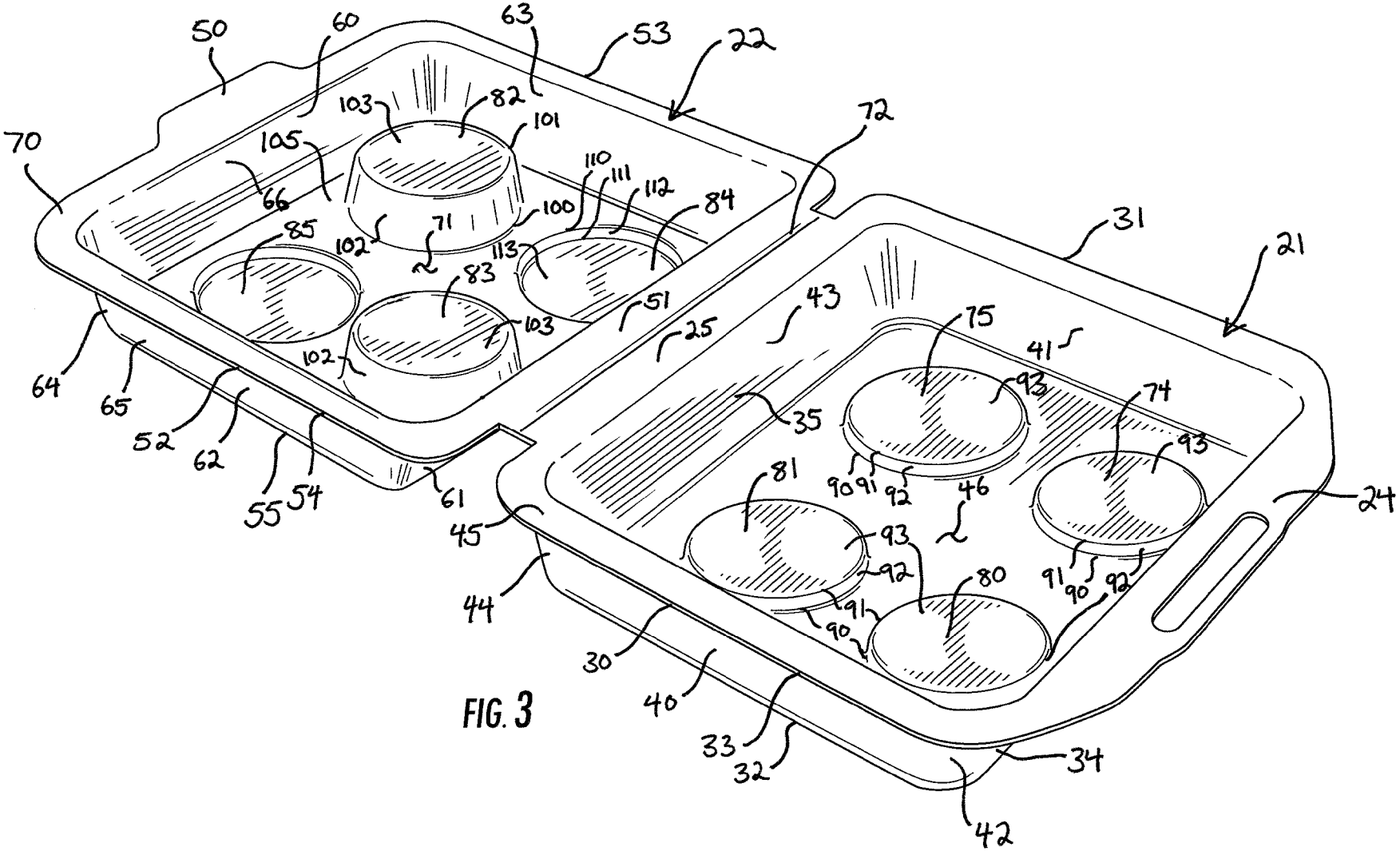
FIG. 3 is a perspective view of the food storage apparatus of FIG. 1, illustrating the lid in an open position away from the base exposing a food storage area.

Referring now to FIGS. 1 and 3, lid 22 has a generally opposite and similar, though not identical, shape and structure to that of base 21. Lid 22 is sized and structured to mate with base 21. As such, lid 22 has a front 50, rear 51, and opposed sides 52 and 53, each respectively relating to front 24, back 25, and opposed sides 30 and 31 of base 21. Lid 22 includes a bottom 54 and an opposed top 55. Extending downwardly from top 55 to bottom 54 is a front wall 60 at front 50 of lid 22, a rear wall 61 at rear 51 of lid 22, and opposed side walls 62 and 63 at opposed sides 52 and 53, respectively, which all together cooperate to form a continuous sidewall 64 between bottom 54 and top 55 of lid 22. Lid 22 has an outer surface 65 and an opposed inner surface 66 which meet at and form a rim 70 along sidewall 64 at bottom 54 of lid 22. Rim 70 defines an opening into an upper storage area 71 bound by inner surface 66 extending into lid 22. Rim 70 at bottom 54 of lid 22 is coextensive and congruent with rim 45 at top 33 of base 22.

Like base 21, lid 22 is fluid impervious and formed of plastic, polystyrene, molded foam, or like materials having light and rigid material characteristics. In the embodiment shown in FIG. 3, front, rear, and side walls 60, 61, 62, and 63 are shown as generally rectangular and coextensive, but in other embodiments, other shapes and sizes are suitable, in which such embodiments front and rear walls 60 and 61 are one of shorter and longer than side walls 62 and 63. In other embodiments, front, rear, and side walls 60, 61, 62, and 63 cooperate to form a cylindrical sidewall about upper storage area 71. In the embodiment shown in FIG. 3, sidewall 42 of base 21 is coextensive with sidewall 64 of base 22, but in other embodiments, sidewall 42 is one of longer and shorter than sidewall 64.

Lid 22 is adapted to mate with base 21. As it is used here, the term "mate" means that lid 22 can be applied and releasably secured to base 21 by placing bottom 54 of lid 22 in contact with top 33 of base 21 so that rim 70 of lid 22 is received against rim 45 of base 21. The manner of mating depends on the structure and configuration of base 21 and lid 22 and is accomplished by one of a clasp closure at fronts 24 and 50 of base 21 and lid 22, respectively, an interlock, a snap fitting, a friction fitting, a crimp-foil edge, or the like. In the embodiment shown in FIG. 3, lid 22 is mounted to base 21 for pivotal movement about a hinge 72 coupling lid 22 to base 21 and formed along rear 25 of base 21 between sides 30 and 31 and along rear 51 of lid 22 between sides 52 and 53. In this embodiment, hinge 72 is preferably a living hinge, though another suitable hinge form may couple lid 22 to base 21. Lid 22 is movable between an open position away from base 21 and a closed position toward base 21. In the open position of lid 22, upper and lower storage areas 71 and 46 are accessible.

Figure 5:
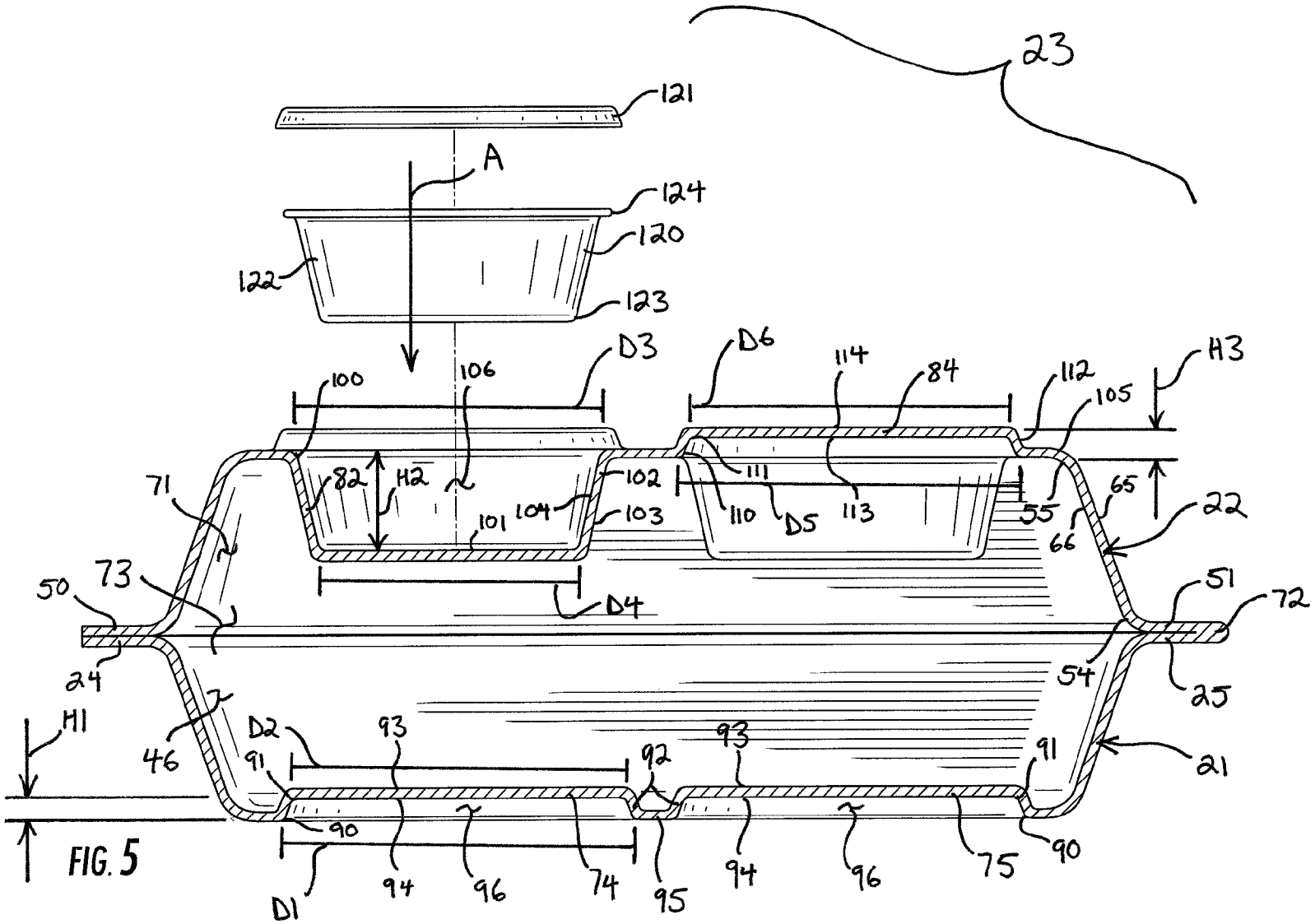
FIGS. 5-7 are section views of the container of FIG. 1 taken along the line 5-5 of FIG. 1 illustrating the steps of applying the cup of FIG. 4 to the cup-receiving seat formed in the lid.

In the closed position of lid 22, upper and lower storage areas 46 and 71 of lid 22 and base 21, respectively, cooperate to form a food storage area 73, shown in FIG. 5, bound by inner surface 43 of base 21 and inner surface 66 of lid 22 and extending from bottom 32 of base 21 to top 55 of lid 22.

Referring now to FIG. 3, base 21 and lid 22 are each formed with structures which relate to each other. Specifically, base 21 is formed with separate, discontinuous sockets 74, 75, 80, and 81, and lid is formed with separate, discontinuous seats 82 and 83 and separate, discontinuous protuberances or protrusions 84 and 85. As such, base 21 and lid 22 are formed with four pairs of relational structures. In embodiments in which base 21 and lid 22 are smaller than those shown in the figures, base 21 and lid 22 are formed with less than four relational structure pairs. In embodiments in which base 21 and lid 22 are larger than those shown in the figures, base 21 and lid 22 are formed with more than four relational structure pairs. In the embodiment shown in the figures, however, sockets 74, 75, 80, and 81, seats 82 and 83, and protrusions 84 and 85 comprise four relational structure pairs, as will now be explained. As illustrated in the figures, sockets 74, 75, 80, and 81 are identical in every respect, other than location and as described herein. Accordingly, only socket 74 will be discussed in detail, with the understanding that the ensuing discussion of socket 74 applies equally to sockets 75, 80, and 81. Socket 74 is formed in base 21 and extends upwardly from base 21 into lower storage area 46. Socket 74 has a bottom 90 formed in base 21 and extends into lower storage area 46 away from inner surface 43 of base 21 to an opposed top 91 along an annular sidewall 92 of socket 74. Socket 74 has an inner surface 93 contiguous with inner surface 43 of base 21 and an opposed outer surface 94 contiguous with outer surface 44 of base 21, forming a continuous, fluid-impervious base structure 95. Outer surface 94 bounds a receiving space 96 in socket 74, and sidewall 92 encircles receiving space 96 from bottom 90 to top 91 of socket 74. With reference now to FIG. 5, socket 74 has a height H1 between bottom 90 and top 91, and a width varying between a first diameter D1 at bottom 90 of socket 74 and a second diameter D2 at top 91 of socket 74. First diameter D1 is greater than second diameter D2. Socket 74 is formed in base 21 proximate to front 24 and side 31 of base 21.

As previously mentioned, socket 74 is identical in every respect to sockets 75, 80, and 81, and throughout the figures, reference characters used to describe the various structural features thereof are applied to sockets 75, 80, and 81 for reference purposes. In common with socket 74, sockets 75, 80, and 81 comprise base structure 95 and each share bottom 90, top 91, sidewall 92, inner surface 93, outer surface 94, receiving space 96, height H1, first diameter D1, and second diameter D2. Sockets 74, 75, 80, and 81 are separate, discontinuous structures formed and spaced apart from each other in base 21. Sockets 74 and 81 are bilaterally symmetric with respect to a line extending diagonally across base 21 between sockets 74 and 81, and sockets 75 and 80 are bilaterally symmetric with respect to a line extending diagonally across base 21 between sockets 75 and 80. Socket 75 is formed in base 21 proximate to rear 25 and side 31 of base 21. Socket 80 is formed in base 21 proximate to front 24 and side 32 of base 21. Socket 81 is formed in base 21 proximate to rear 25 and side 32 of base 21.

Sockets 74, 75, 80, and 81 relate to seat 82, protrusion 84, protrusion 85, and seat 83, respectively, formed in lid 22. Seats 82 and 83 are identical in every respect, other than location and as described herein, and protrusions 84 and 85 are identical in every respect, other than location and as described herein. Accordingly only seat 82 and protrusion 84 will be discussed in detail, with the understanding that the ensuing discussions of seat 82 and protrusion 84 apply equally to seat 83 and protrusion 85, respectively.

With reference to FIGS. 1 and 5, seat 82 has a top 100 formed in lid 22 and depends downwardly from lid 22 into upper storage area 71 away from inner surface 66 of lid 22 along an annular sidewall 102 of seat 82 to an opposed bottom 101 located opposite inner surface 66. Seat 82 has an inner surface 103 contiguous with inner surface 66, and an opposed outer surface 104 contiguous with outer surface 65 of lid 22, forming a continuous, fluid-impervious lid structure 105. Inner surface 103 of seat 82 bounds a cup-receiving space 106 in seat 82 such that seat 82 is a cup-receiving seat, and sidewall 102 encircles cup-receiving space 106 from top 100 to bottom 101 of seat 82. With reference now to FIG. 5, seat 82 has a depth H2 between top 100 and bottom 101, and a width varying from a first diameter D3 at top 100 of seat 82 to a second diameter D4 at bottom 101 of seat 82. First diameter D3 is greater than second diameter D4. Seat 82 is formed in lid 22 proximate to front 50 and side 53 of lid 22, such that when lid 22 is in the closed position, socket 74 in base 21 opposes and is spaced apart from seat 82 in lid 22 on the opposed side of food storage area 73.

As previously mentioned, seat 82 is identical in every respect to seat 83, and throughout the figures, reference characters used to describe the various structural features thereof are applied to seat 83 for reference purposes. In common with seat 82, seat 83 comprises lid structure 105 and shares top 100, bottom 101, sidewall 102, inner surface 103, outer surface 104, cup-receiving space 106, height H2, first diameter D3, and second diameter D4. Seats 82 and 83 are separate, discontinuous structures formed and spaced apart from each other in lid 22, and are bilaterally symmetric with respect to a line extending diagonally across lid 22 between seats 82 and 83. Seat 83 is formed in lid 22 proximate to rear 51 and side 52 of lid 22, such that when lid 22 is in the closed position, socket 74 in base 21 opposes and is spaced apart from seat 83 in lid 22 on the opposed side of food storage area 73.

With reference now to FIG. 1, protrusion 85 has a bottom 110 formed in lid 22 and extends upwardly from lid 22 away from outer surface 65 of lid 22 to an opposed top 111 along an annular sidewall 112 of protrusion 84. Protrusion 84 has an inner surface 113 contiguous with inner surface 66 of lid 22 and an opposed outer surface 114 contiguous with outer surface 65 of lid 22, comprising lid structure 105. With reference now to FIG. 5, protrusion 84 has a height H3 between bottom 110 and top 111, and a width varying from a first diameter D5 at bottom 110 to a second diameter D6 at top 111 of protrusion 84. First diameter D5 is greater than second diameter D6. Protrusion 84 is formed in lid 22 proximate to rear 51 and side 53 of lid 22, such that when lid 22 is in the closed position, socket 75 in base 21 opposes and is spaced apart from protrusion 84 in lid 21.

As previously mentioned, protrusion 84 is identical in every respect to protrusion 85, and throughout the figures, reference characters used to describe the various structural features thereof are applied to protrusion 85 for reference purposes. In common with protrusion 84, protrusion 85 comprises lid structure 105, and shares bottom 110, top 111, sidewall 112, inner surface 113, outer surface 114, height H3, first diameter D5, and second diameter D6. Protrusions 84 and 85 are separate, discontinuous structures formed and spaced apart from each other in lid 22, and are bilaterally symmetric with respect to a line extending diagonally across lid 22 between protrusions 84 and 85. Protrusion 85 is formed in lid 22 proximate to front 50 and side 52 of lid 22, such that when lid 22 is in the closed position, socket 80 in base 21 opposes and is spaced apart from protrusion 85 in lid 22.

Figure 4:
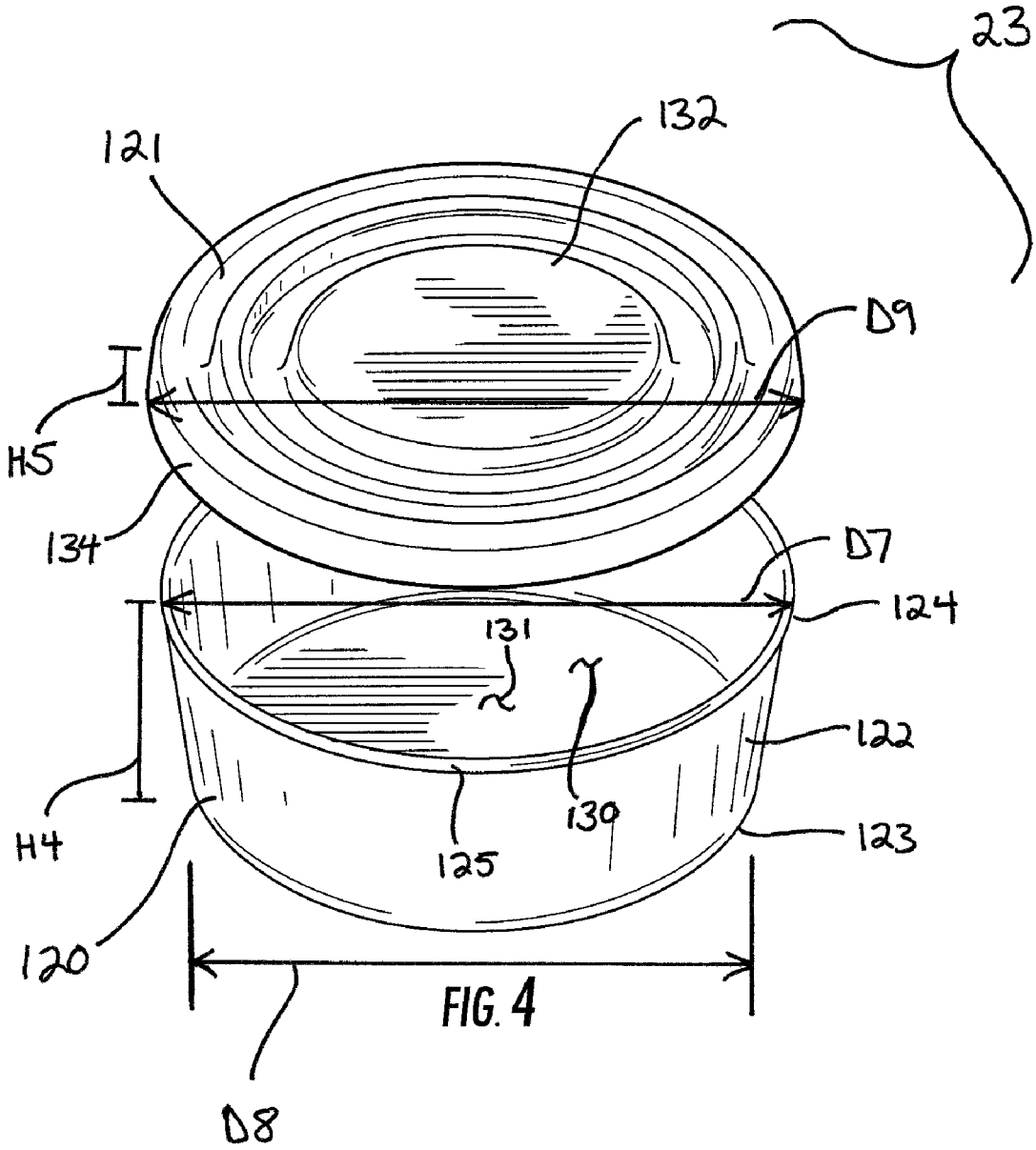
FIG. 4 is an exploded perspective view of the cup of FIG. 1.

FIG. 4 illustrates cup 23. Cup 23 is common and known in the art as a "soufflé cup" for holding sauces, side dishes, cheeses, and the like. Cup 23 includes a container 120 and a cap 121. Container 120 has a continuous, annular sidewall 122 extending between a bottom 123 and an opposed top 124. Sidewall 122 terminates at rim 125 located at top 124 of container 120, and rim 125 defines an opening 130 into a food containment area 131 encircled by sidewall 122 and extending between bottom 123 and top 124 of container 120. Container 120 includes opposed inner and outer surfaces 132 and 133. Rim 125 is an enlarged portion of sidewall 122 and is adapted to snappingly receive cap 121 thereon. Container 120 has a height H4 between bottom 123 and top 124, and a width varying from a first diameter D7 at top 124 to a second diameter D8 at bottom of container 120. First diameter D7 is greater than second diameter D8.

Cap 121 includes an upper surface 132, an opposed lower surface 133 (not shown), a perimeter 134, and a downwardly-turned lip 135 formed along perimeter 134. In the embodiment shown in FIG. 4, perimeter 134 is circular and has a diameter D9 which relates to diameter D7 of container 120 at rim 125. Cap 121 has a height H5, which is less than half the height H4 of container 120. Cap 121 is moveable between an open position with respect to container 120 providing access to food containment area 131 and a closed position with respect to container 120 closing container 120 and enclosing food containment area 131. In the closed position of cap 121, food containment area 131 is bound by sidewall 122 and bottom 123 of container and lower surface 133 of cap 121. In the closed position of cap 121, lip 135 of cap 121 fits over rim 124 of container 120 such that height H5 of cap 121 depends downwardly from rim 124 at top 124 of container 120, first diameter D7 of container 120 fits snugly within diameter D9 of cap 121, and cap 121 is snappingly received on container 120. In the closed position of cap 122, cup 23 has a height equal to height H4 of container 120 and has diameters equal to first and second diameters D7 and D8 at top 123 and bottom 124 of container 120, respectively.

Food storage apparatus 20 is useful for storing and transporting food items. Small food items are placed within food containment area 131 of cup 23 and large food items are placed within food storage area 73 formed between base 21 and lid 22. Food storage apparatus 20 is also useful for carrying small and large food items together, as by nesting cup 23 to lid 22.

Figure 6:
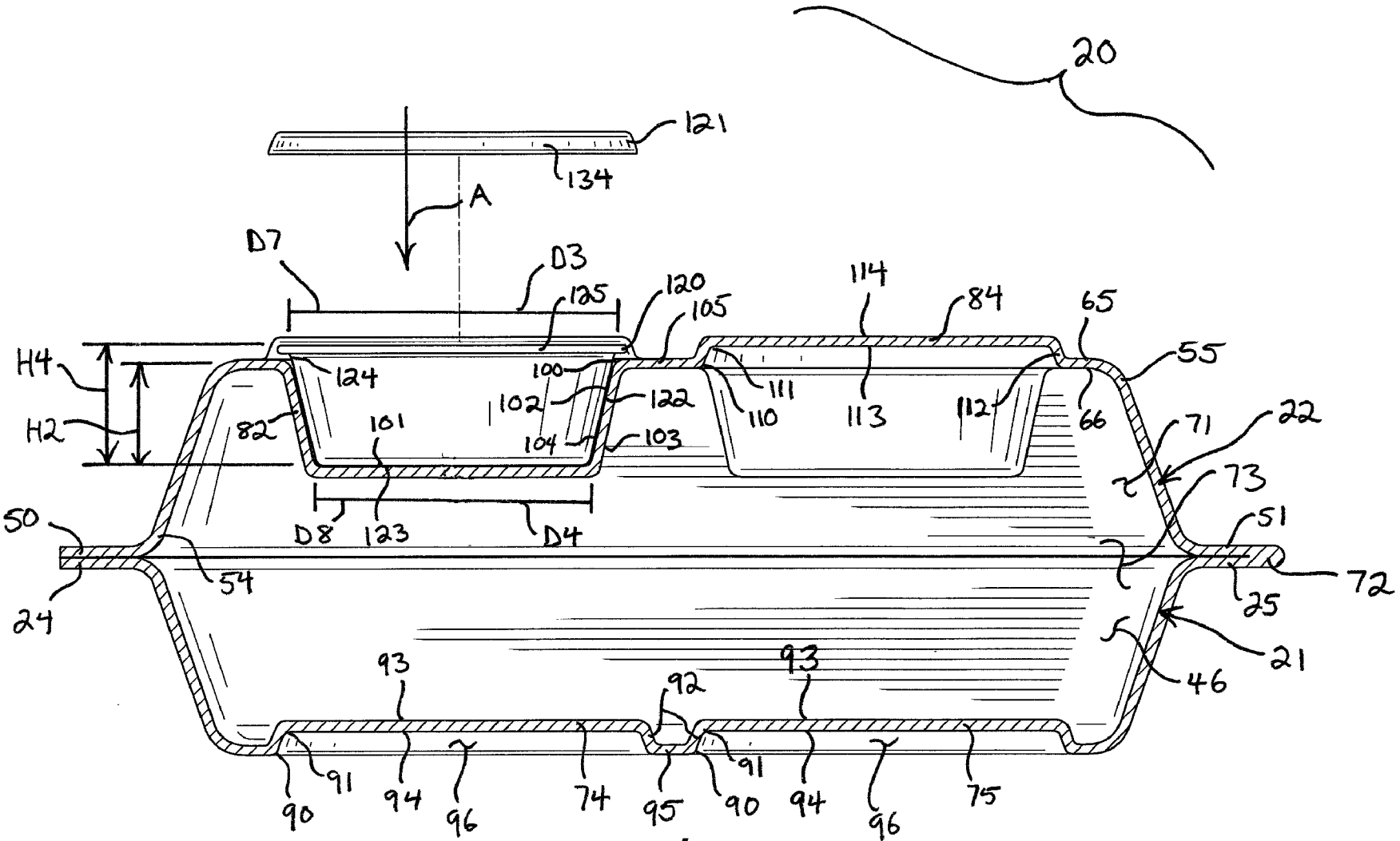
Figure 7:
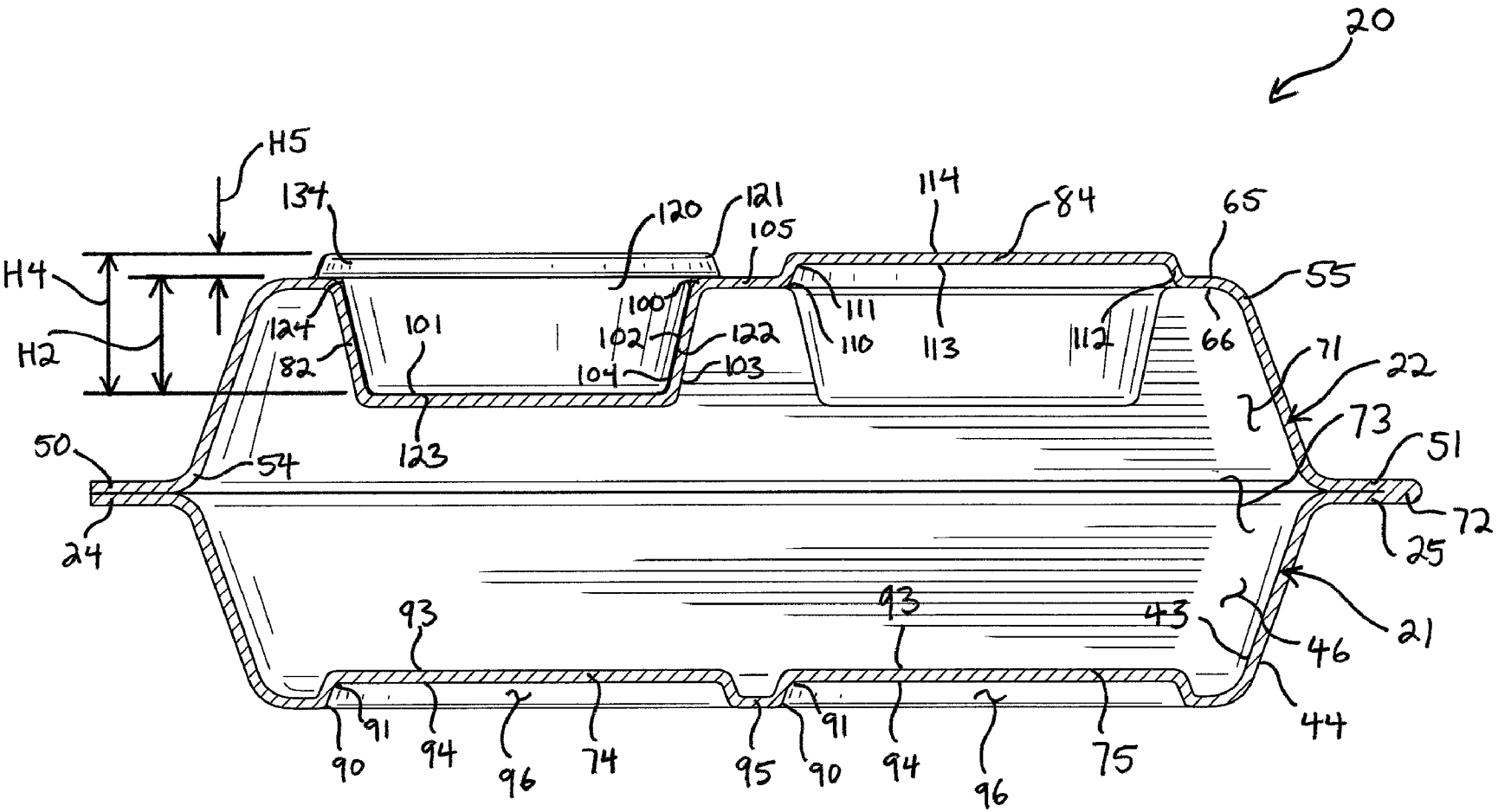

To store and transport large food items, a user need only pick up large food items, place them within lower storage area 46, and then move lid 22 from the open position to the closed position thereof. With lid 22 in the closed position with respect to base 21, food items in food storage area 73 are contained within and will not spill outside of base 21 and lid 22. Further, with lid 22 in the closed position thereof, cup 23 is available to move from a free position removed from lid 22, as shown in FIG. 5, to a storage position applied to seat 82 in lid 23, as shown in FIG. 7, so as to be carried securely together with base 21 and lid 22 in a nesting arrangement. Sidewall 122 and bottom 123 of seat 82 together comprise a nesting element of a nesting assembly. Bottom 101 and sidewall 102 of seat 82 together comprise a complemental nesting element of the nesting assembly. To move cup 23 from the free position to the storage position thereof, one need only pick up container 120, align container 120 with seat 82, and move container 120 in a direction along arrowed line A in FIG. 5 toward seat 82, stacking container 120 within seat 82 in a nesting arrangement, as shown in FIG. 6, with bottom 123 of container 120 resting in contact upon bottom 101 of seat 82 and sidewall 122 of container 120 against sidewall 102 of seat 82. In this arrangement, cup 23 is received, positioned, and held within cup-receiving space 106 of seat 82, diameter D7 at top 124 of container 120 is received within diameter D3 at top 100 of seat 82, and diameter D8 at bottom 123 of container 120 is received within diameter D4 at bottom 101 of seat 82. Cup 23 extends above outer surface 65 of lid 22 and depends below inner surface 66 of lid 22. As seen in FIG. 6, a majority of height H4 of container 120, and a majority of food containment area 131, depends downwardly from top 124 of container 120 located at outer surface 65 of lid 22 to bottom 123 of container 120 extending into depth H2 of seat 82 into bottom 101 of seat 82 located within upper storage area 71 of food storage area 73, such that only rim 125 at top 124 of container 120 projects opposite to and above outer surface 65 of lid 22, forming a protuberance in lid 22 extending upwardly with respect to outer surface 65 of lid 22.

With cup 23 applied to cup-receiving space 106 in seat 82 in a nesting arrangement, cup 23 is arranged or formed in seat 82 of lid 22, and to carry small food items along with large food items, a user applies small articles or small food items to food containment area 131 of cup 23. The user can then carries food storage apparatus 20 or applies cap 121 to container 120. A user applies cap 121 to container 120 by aligning cap 121 over container 120, moving cap 121 along arrowed line A shown in FIG. 6, and snappingly fitting lip 134 over rim 125 of container 120 so that cap 121 is applied to and received on container 120. In this arrangement, cap 121 contacts outer surface 65 of lid 22, cap 121 is secured and held in place on container 120 with respect to lid 22, and height H5 of cap 121 projects above outer surface 65 of lid 22, as seen in FIG. 7, forming a protuberance in lid 22 extending upwardly with respect to outer surface 65 of lid 22. It should be understood that, although the process of moving cup 23 from a free position to a storage position is described here in a sequence of steps, that sequence can be altered. One will readily appreciate that a user desiring to carry small food items with large food items may fill container 120 with small food items, apply cap 121 to container 120, and then nestingly engage cup 23 comprising container 120 and cap 121 within seat 82 formed in lid 22, or that user may fill container 120 with small food items and then nestingly engage container 120 to cup-receiving space 106 without applying cap 121, or that user may simply apply small food items directly to cup-receiving space 106 in lid 22. Additionally, one will readily appreciate that a user desiring to carry only large food items, or a user with no concern for food safety or security, may fill container 120 only.

With cup 23 in the storage position thereof, cup 23 is held and supported securely with respect to lid 22 in an interference fit between cup 23 and seat 82. Inner surface 103 of sidewall 102 along depth H2 of seat 82 frictionally interacts with sidewall 122 along height H4 of container 120 to inhibit lateral movement of cup 23 within seat 82, providing a stable arrangement in which to carry cup 23 in seat 82 with respect to lid 22. In the same manner as described above, cup 23 is applied to seat 83 so that cup 23 may be carried in seat 83, as shown in FIG. 1.

To remove cup 23 from seat 82, one need only grasp top 124 of cup 23 and lift upwardly. Cup 23 projects above outer surface 65 of lid 22 along height H5, presenting rim 125 and cap 121 on rim 125 extending above lid 22 so as to be easy to grasp and lift cup 23 from cup-receiving space 106 in seat 82.

Figure 8:
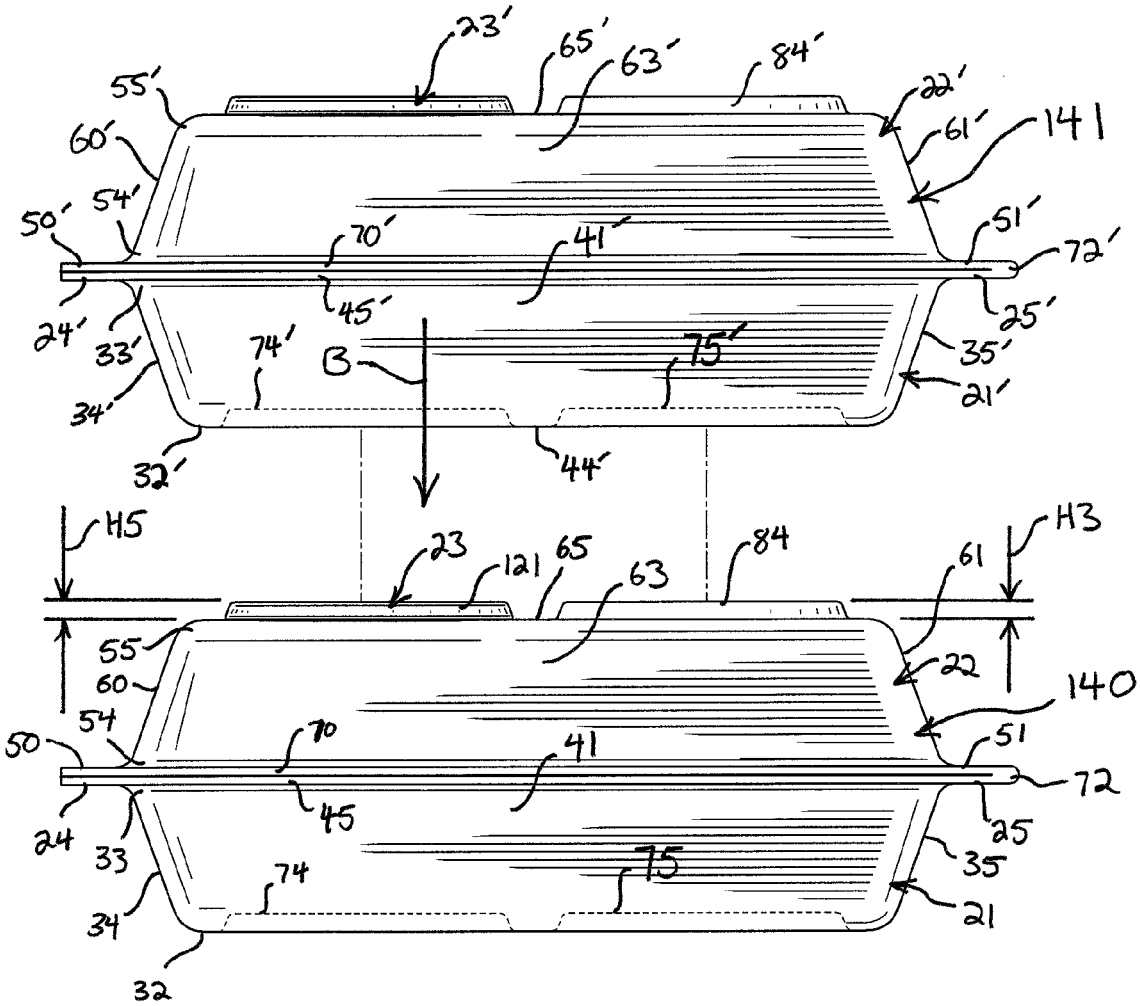
FIGS. 8 and 9 are side elevation views illustrating the steps of applying the container of FIG. 1 to another container, forming a stacked food storage apparatus constructed and arranged in accordance with the principle of the invention.

With reference now to the sequence of steps illustrated in FIGS. 8-11, a stacked food storage apparatus 135 is formed for storing and transporting multiple small and large food items. FIG. 8 illustrates first and second food containers 140 and 141 separate from each other. First container 140 is identical in every respect to food storage apparatus 20, and throughout FIGS. 8-11, reference characters used to describe the various structural features thereof are applied to first container 140. First container 140 carries seats 82 and 83 as well as cup 23 nested within seat 82 in the storage position thereof, as described above with reference to food storage apparatus 20. Height H5 of cup 23 projects above outer surface 65 of lid 22 and is equal to height H3 of protrusion 84 extending above outer surface 65 of lid 22. Although not shown in FIGS. 8-11, first container 140 also carries a cup 23 nested within seat 83 in the storage position thereof.

Figure 9:
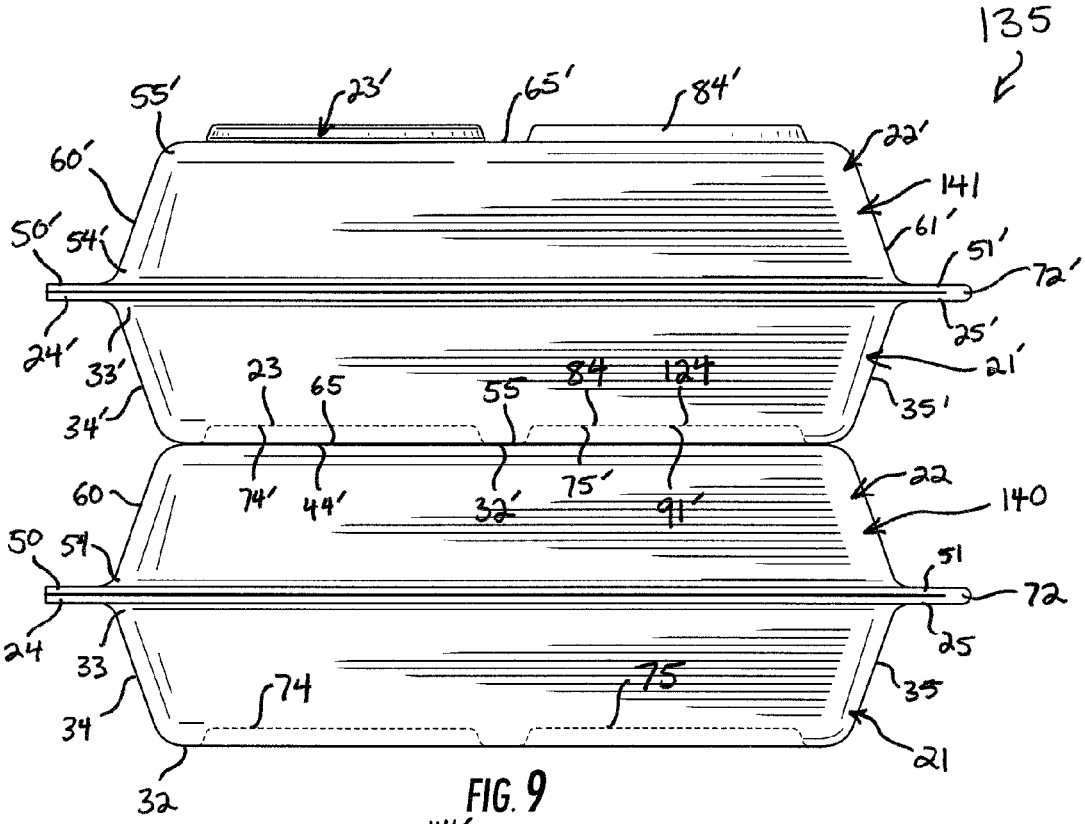
Figure 10:
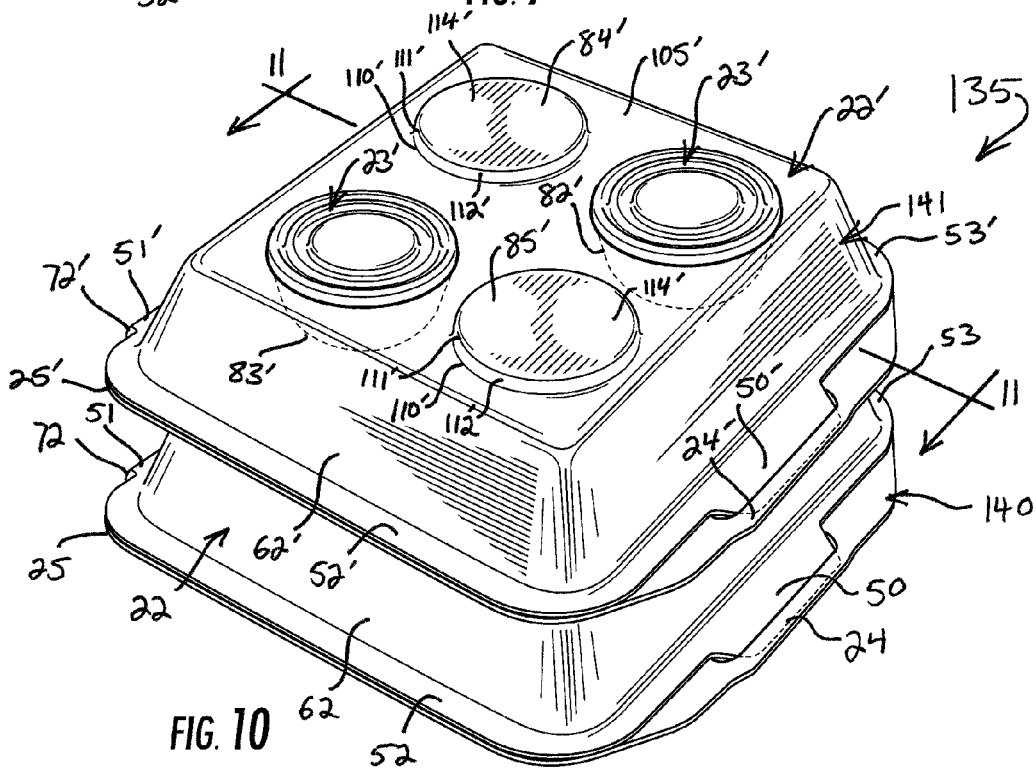
FIG. 10 is a top perspective view of the stacked food storage apparatus of FIG. 9.

Second container 141 is identical in every respect to food storage apparatus 20, and throughout FIGS. 8-11, reference characters used to describe the various structural features thereof are applied to second container 141, but are designated with a prime ("') so as to distinguish those structural features from the structural features of first container 140. Second container 141 carries sockets 74' and 75', and although not shown in FIGS. 8-11, also carries sockets 80' and 81'. Second container 141 also carries, as shown in FIG. 10, cups 23' received in seats 82' and 83', and protrusions 84' and 85'.

Referring back now to FIG. 8, with cup 23 arranged in the storage position thereof within seat 82 of lid 22 of first container 140, cup 23 forms a first engagement assembly between first and second containers 140 and 141 and defines an engagement element of the first engagement assembly. When cup 23 is removed from seat 82, the first engagement assembly is removed and second container 141 is free from first container 140 at socket 74' and seat 82. The first engagement assembly includes cup 23 in the storage position thereof in seat 82 projecting along height H5 above outer surface 65 of lid 22, and socket 74' carried on base 21' of second container 141, which when engaged together releasably secure second container 141 to first container 140. Protrusion 84 and socket 75' form a second engagement assembly, which when engaged together releasably secure second container 141 to first container 140. A third engagement assembly is formed between other cup 23 nesting within seat 83 in the storage position thereof and projecting along height H5 about outer surface of lid 22 and socket 81'. A fourth engagement assembly is formed between protrusion 85 and socket 80'. The third and fourth engagement assemblies are identical in structure and function to the first and second engagement assemblies, respectively, but are not illustrated in the figures. Accordingly, discussion will be limited to the structural and functional details of the first and second engagement assemblies with the understanding that the ensuing discussion applies equally to each of the third and fourth engagement assemblies, respectively.

Second container 141 is moveable between a free position away from first container 140 and a stacked position applied to first container 140, forming stacked food storage apparatus 135. To move second container 141 into the stacked position thereof to form stacked food storage apparatus 135, one need only take up second container 141, as by hand, and align it with first container 140, registering rear 25' of base 21' of second container 141 with rear 51 of lid 22 of first container 140, front 24' of base 21' of second container 141 with front 50 of lid 22 of first container 140, socket 74' with cup 23 in seat 82, and socket 75' with protrusion 84, and then move second container 141 along arrowed line B shown in FIG. 8, applying cup 23 to socket 74', protrusion 84 to socket 75' and contacting outer surface 44' of base 21' to outer surface 65 of lid 22, as shown in FIG. 9, to form stacked food storage apparatus 135 illustrated in perspective view in FIG. 10. It should be understood that because sockets 74 and 81 are bilaterally symmetric, sockets 75 and 80 are bilaterally symmetric, seats 82 and 83 are bilaterally symmetric, and protrusions 84 and 85 are bilaterally symmetric, registering rear 25' with rear 51 is not essential, as second container 141 can be rotated with respect to first container 140 so that a protrusion and a seat register with sockets.

Figure 11:
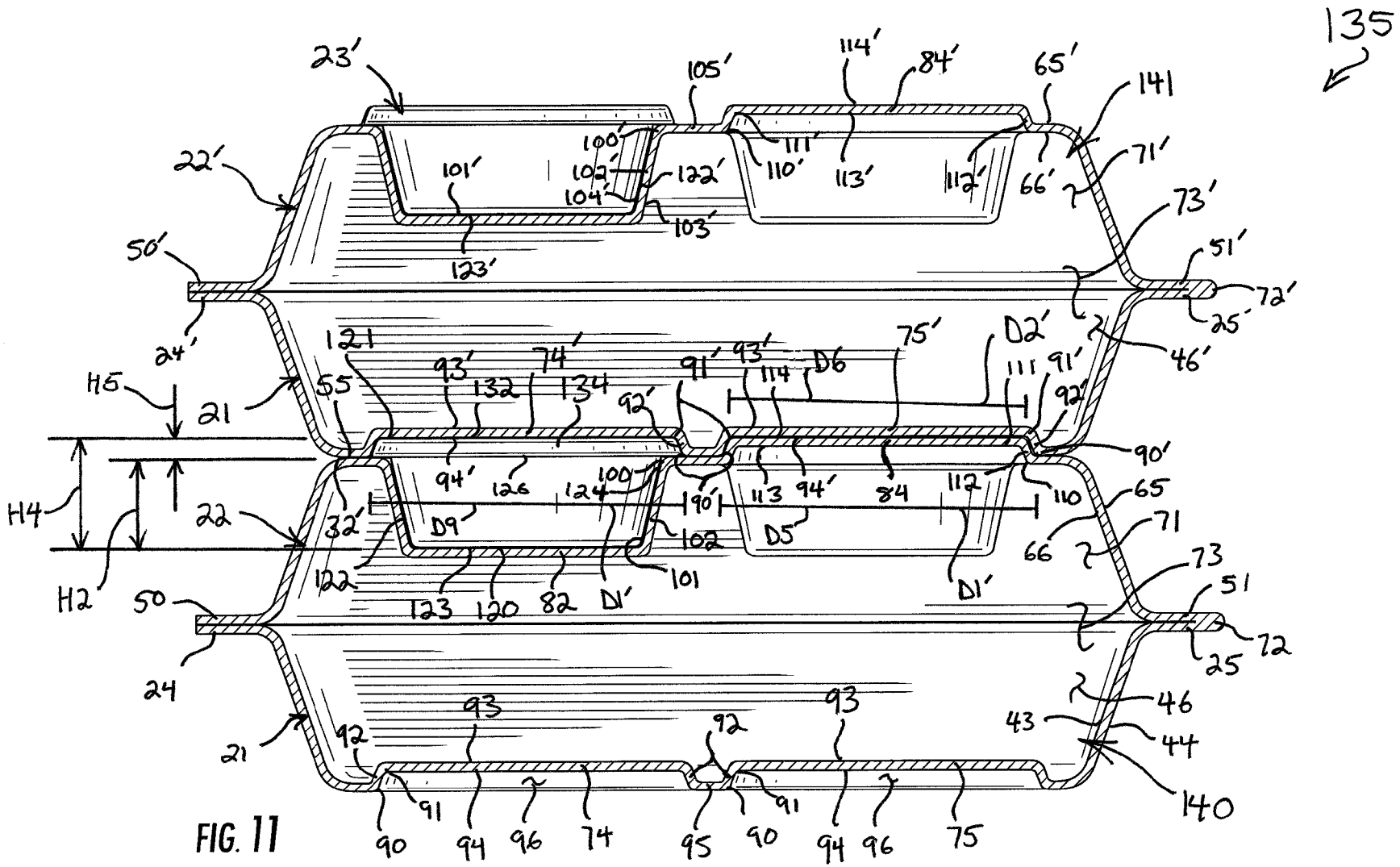
FIG. 11 is a section view of the stacked food storage apparatus of FIG. 9 taken along the line 11-11 of FIG. 10.

In this arrangement and with reference now to FIG. 11, bottom 32' of base 21' of second container 141 is received against, directly contacts, and rests upon top 55 of lid 21 of first container 140, such that outer surface 44' of base 21' is in contact with outer surface 65 of lid 22 and a bottom area extending across outer surface 44' at bottom 32' of base 21' is applied in continuous contact against a top area extending across outer surface 65 at top 55 of lid 22. The first engagement assembly formed between first and second containers 140 and 141 including cup 23 in seat 82 and socket 74' holds second container 141 in place upon first container 140. The first engagement assembly comprises an interference fit between cup 23 in seat 82 and socket 74' that attaches second container 141 to first container and restricts the relative movement of first and second containers 140 and 141. In the interference fit, the relative axial and radial freedom of motion between cup 23 in seat 82 and socket 74' is limited such that interference always results when cup 23 applied in seat 82 is engaged with socket 74'. Top 124 of cup 23 extends into receiving space 96' of socket 74' so as to be positioned near top 91' of socket 74', sidewall 92' of socket 74' closely encircles lip 134 of cap 121 applied to cup 23, and inner surface 93' of socket 74' receives in juxtaposition upper surface 132 of cap 121 on cup 23. Height H4 of cup 23 extends from top 91' of socket 74' to bottom 90 of seat 82, with a portion of cup 23 having a first dimension equal to height H4 less height H5 depending downwardly from lid 22 into seat 82, positioning a majority of height H4 of cup 23 so as to extend downwardly into seat 82, and another portion or extension of cup 23 near top 124 of cup 23 having a second dimension equal to height H5 of cap 121 extending between top 124 of cup 23 at top 91' of socket 74' and outer surface 65 of lid 22, positioning a minority of height H4 of cup 23 so as to extend upwardly into socket 74'. The first dimension of cup 23 equal to height H4 less height H5 extends from bottom 123 of cup 23 to a middle portion 126 of cup 231 located between bottom 123 and top 124 of cup 23. The second dimension of cup 23 extends from middle portion 126 to top 124 of cup 23, and in embodiments in which cap 121 is applied to cup 123 the second dimension includes cap 121. Cup 23 has a geometric center located centrally along a vertical axis extending through cup 23, and middle portion 126 is a plane extending through cup proximate to top 124 and between bottom 123 and top 124 of cup. Middle portion 126 is located between top 124 and the geometric center of cup 23, such that the first dimension of cup 23 equal to height H5 of cap 121 is greater than the second dimension equal to height H4 less height H5. With cup 23 in the storage position thereof, middle portion 126 of cup is co-planar with a plane extending along outer surface 65 of lid 22. Diameter D1' of socket 74' and diameter D9 of cap 121 correspond such that when second container 141 is stacked on first container 140, diameter D9 of cap 121 of cup 23 applied to first container 140 fits within and is closely encircled by first diameter D1' of socket 74' of second container 141. In this interference fit engagement, cup 23 in seat 82 frictionally engages socket 74' to resist relative axial and radial movement between cup 23 in seat 82 and socket 74'. The second engagement assembly formed between first and second containers 140 and 141 including protrusion 84 and socket 75' holds second container 141 in place upon first container 140. Protrusion 84 extends along height H3 into receiving space 96' of socket 75' along height H1' so as to be positioned near top 91' of socket 75', sidewall 92' of socket 75' encircles sidewall 112 of protrusion 84, and inner surface 93' of socket 75' receives in juxtaposition outer surface 114 of protrusion 84. First diameter D5 of protrusion 84 formed on first container 140 fits within and is closely encircled by first diameter D1' of socket 75' carried by second container 141, and second diameter D6 of protrusion 84 formed on first container 140 fits within and is closely encircled by second diameter D2' of socket 75' carried by second container 141.

With second container 141 in the stacked position thereof with respect to first container 140, forming stacked food storage apparatus 135, second container 141 is held and supported securely with respect to lid 22 of first container 140 by the first engagement assembly consisting of cup 23 in the storage position thereof in seat 82 projecting along height H5 above lid 22 and socket 74', and by the second engagement assembly consisting of protrusion 84 and socket 75', so as to inhibit lateral movement of second container 141 across top 55 of lid 22 of first container 140. Inner surface 103 of seat 82 encounters sidewall 122 of cup 23, and inner surface 93' of socket 74' encounters rim 125 of cup 23, so as to cooperatively prevent lateral movement of cup 23 within both seat 82 and socket 74' and of second container 141 with respect to first container 140. Inner surface 93' of socket 84 encounters sidewall 112 of protrusion 84 and prevents lateral movement of protrusion 84 within socket 75' and of second container 141 with respect to first container 140.

Further, in this arrangement, cup 23 is held securely between lid 22 of first container 140 and base 21' of second container 141, thereby preventing cup 23 from coming loose from first and second containers 140 and 141. Indeed, with second container 141 applied to first container 140, cup 23 is contained within a cavity bound by outer surface 94' of socket 74' of second container 141 and outer surface 65 of lid 22 near seat 82 of first container 140. In this arrangement, a user can securely carry multiple small and large food items together without risk of second container 141 slipping or sliding off first container 140 and without risk of spilling the contents of cup 23 within food storage area 73 or outside of first and second containers 140 and 141. Moreover, with cups 23' applied to seats 82' and 83' as shown in FIG. 10, second container 141 is ready to receive another container on lid 22' of second container 141, just as second container 141 has been described above to receive first container 140. Several containers can be stacked upon one another while maintaining a stable arrangement.

To disassemble stacked food storage apparatus 135, one need only lift second container 141 away from first container 140, as by reversing the steps described above. With second container 135, cup 23 is presented so as to be available to remove cup 23 from seat 82.

In the foregoing discussion, reference has been made to cup 23 applied in seat 82 forming a first engagement assembly between cup 23 and socket 74' with the understanding that such discussion applied equally to the third engagement assembly. Though it is not shown in the drawings, it should be understood that a single cup 23 may be applied to one of seats 82 and 83, so that when cup 23 is applied to one of seats 82 and 83, cup 23 forms an engagement assembly between first and second containers 140 and 141, said engagement assembly including cup 23 in one of seats 82 and 83 and one of sockets 74' and 81', respectively.

Figure 12:
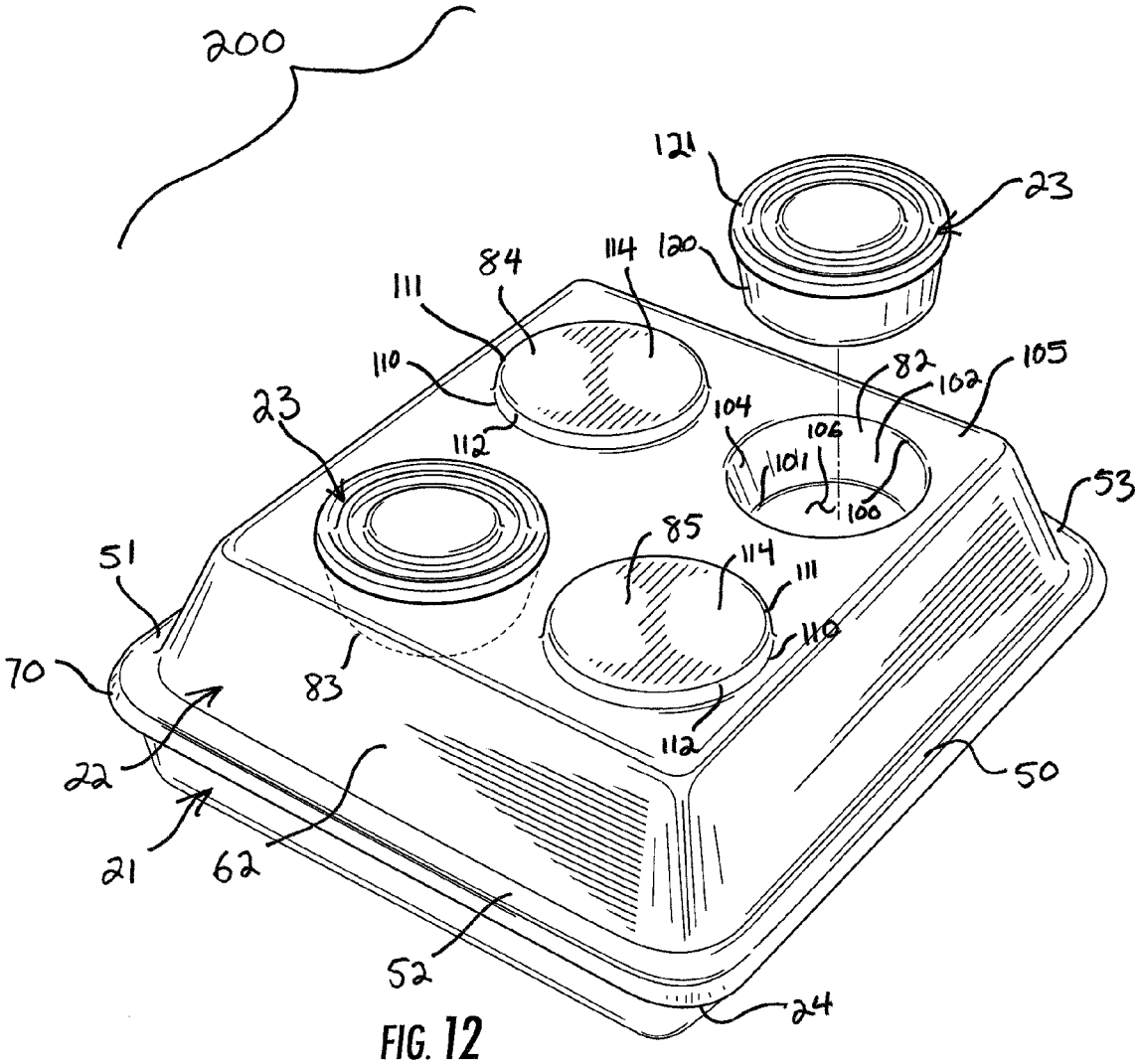
FIG. 12 is a top perspective view of a food storage apparatus constructed and arranged in accordance with the principle of the invention, including a base, a lid, a protrusion, a cup-receiving seat formed in the lid, and a cup.
Figure 13:
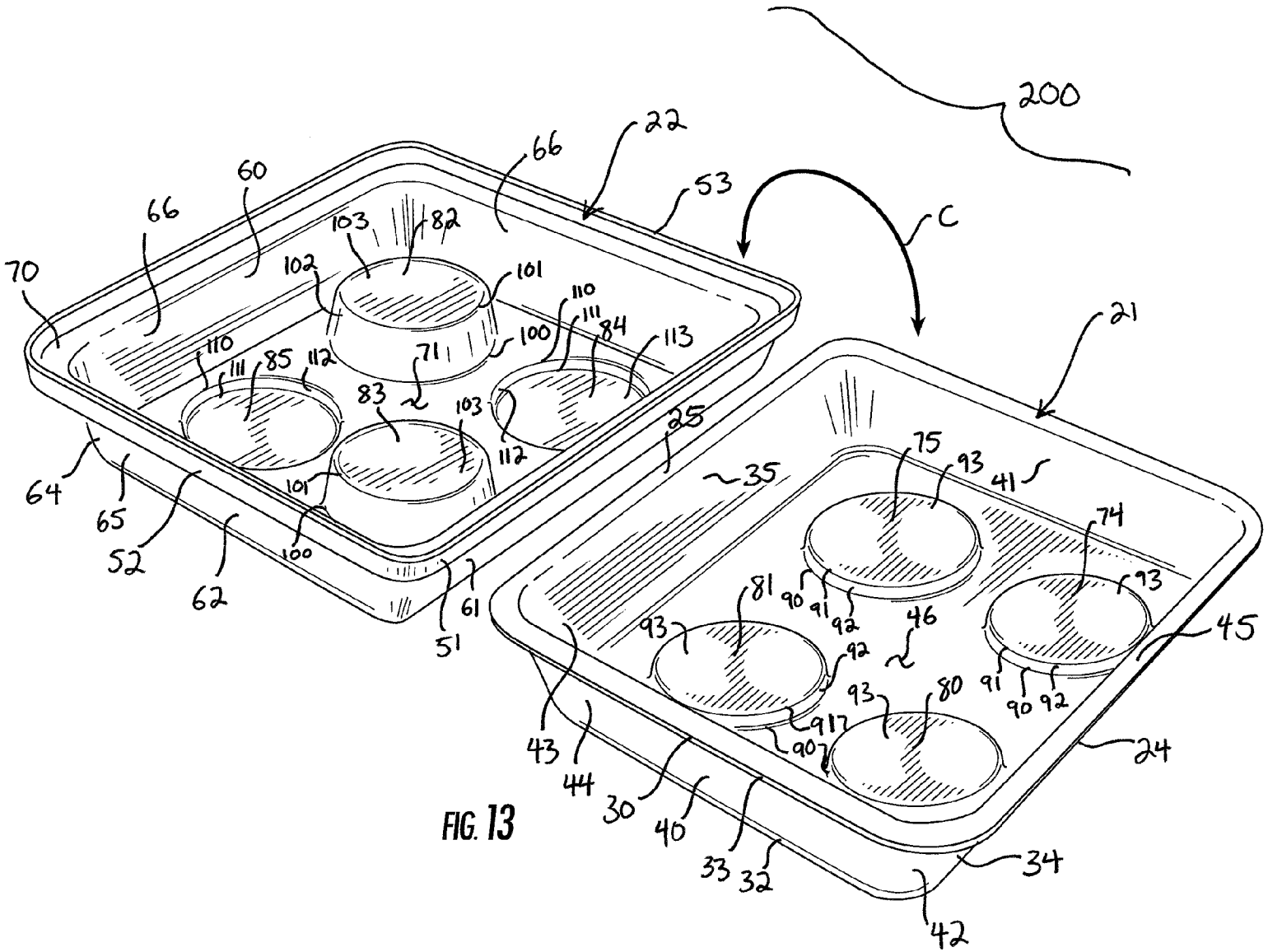
FIG. 13 is a perspective view of the food storage apparatus of FIG. 12, illustrating the lid in an open position away from the base exposing a food storage area.

Turning finally to FIGS. 12 and 13, an embodiment of the present invention is shown. Food storage apparatus 200 is identical in every respect to food storage apparatus 20, and throughout FIGS. 12 and 13, reference characters used to describe the various common structural features of food storage apparatus 20 are applied to food storage apparatus 200 for reference purposes. For instance, in common with food storage apparatus 20, food storage apparatus 200 comprises a base 21, a lid 22, a cup 23, front 24 and rear 25 of base 21, opposed sides 30 and 31 of base 21, front 50 and rear 51 of lid 22, opposed sides 52 and 53 of lid 22, inner surface 43 of base 21, lower storage area 46, inner surface 66 of lid 22, upper storage area 71, sockets 74, 75, 80, and 81, seats 82 and 83, and protrusions 84 and 85.

Base 21 is releasably separable from lid 22. Lid 22 is moveable between an open position away from base 21 and a closed position toward base 21. In the open position of lid 22, lid 22 is released from base 21, forming two separate pieces of food storage apparatus 200 and providing access to each of lower and upper storage areas 46 and 71. In the closed position of lid 22, lid 22 is in contact with base 22, enclosing lower and upper storage areas 46 and 71 and forming food storage area 73 bound by inner surfaces 43 and 66 of base 21 and lid 22, respectively. To move lid 22 from the open position to the closed position thereof, one need only take up lid 22, as by hand, align lid 22 with base 21, and apply lid 22 to base 21. Rim 45 of base 21 receives rim 70 of lid 22 in direct contact and engages lid 22 to base 21 by an engagement structure formed between rim 45 and rim 70 as is common in the art, such as an interlock, a snap fitting, friction fitting, crimp-foil edge, or the like. Alternatively, to move lid 22 from the closed position to the open position thereof, one need only take up lid 22, as by hand, and remove lid 22 from base 21, preferably along a direction indicated by double-arrowed line C illustrated in FIG. 13.

The present invention is described above with reference to a preferred embodiment. However, those skilled in the art will recognize that changes and modifications may be made in the described embodiment without departing from the nature and scope of the present invention. Various further changes and modifications to the embodiment herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. A food storage apparatus comprising:

a base including opposed inner and outer surfaces;

discontinuous first and second sockets formed in the base;

a lid moveable between an open position away from the base and a closed position toward the base, the lid including opposed inner and outer surfaces;

a protrusion formed in the lid;

a cup-receiving seat formed in the lid;

a cup moveable between free and storage positions relative to the seat, the cup including a top, an opposed bottom, a food containment area formed between the top and the bottom, and a height extending between the top and bottom;

in the closed position of the lid, the inner surface of the lid and the inner surface of the base cooperate to bound a food storage area formed between the base and the lid;

in the closed position of the lid, the protrusion in the lid relates to and is spaced apart from the first socket in the base, and the seat in the lid relates to and is spaced apart from the second socket in the base;

in the storage position of the cup, the cup is received in the seat, a majority of the height of the cup extends into the seat, and a majority of the food containment area extends into the seat; and in the storage position of the cup, an interference fit couples the seat and the cup, wherein the interference fit restricts relative movement of the cup and the seat, and is characterized in that the cup relates to and frictionally engages the seat.

2. A food storage apparatus according to claim 1, wherein in the storage position of the cup the top of the cup extends away from the outer surface of the lid.

3. A food storage apparatus according to claim 1, wherein the protrusion has a height extending from a bottom of the protrusion formed in the lid to a top of the protrusion.

4. A food storage apparatus according to claim 1, further comprising:

the protrusion has an outer diameter;

the first socket has an inner diameter;

the outer diameter of the protrusion corresponds to the inner diameter of the first socket;

the cup has an outer diameter;

the second socket has an inner diameter; and the outer diameter of the cup corresponds to the inner diameter of the second socket.

5. A food storage apparatus according to claim 3, further comprising:

the first socket has a height extending into the base from the outer surface of the base;

the second socket has a height extending into the base from the outer surface of the base; and the heights of the first and second sockets each correspond to the height of the protrusion.

6. A food storage apparatus according to claim 1, wherein the lid and the seat together comprise a unitary, fluid-impervious lid structure.

7. A food storage apparatus according to claim 1, wherein the lid is mounted to the base for pivotal movement between the open and closed positions of the lid.

8. A food storage apparatus according to claim 1, further comprising:

in the open position of the lid, the lid is released from the base; and in the closed position of the lid, the lid is in contact with the base.

* * * * *